United States Patent [19]

Mallinson

[11] 4,233,901

[45] Nov. 18, 1980

[54] DRYING PRINTED WEB MATERIAL

[75] Inventor: Leonard B. Mallinson, Blackburn, England

[73] Assignee: Baker Perkins Holdings, Ltd., Peterborough, England

[21] Appl. No.: 922,617

[22] Filed: Jul. 7, 1978

[30] Foreign Application Priority Data

Nov. 9, 1977 [GB] United Kingdom ..... 46538/77

[51] Int. Cl.[3] ..... B41F 23/04

[52] U.S. Cl. ..... 101/416 A; 34/77

[58] Field of Search ..... 101/416 A, 416 R; 34/76, 77

[56] References Cited

U.S. PATENT DOCUMENTS

| | | | |
|---|---|---|---|
| 2,306,607 | 12/1942 | Hoxton | 101/416 A |
| 4,043,051 | 8/1977 | Lussenden | 34/77 |
| 4,137,646 | 2/1979 | Fuhring | 34/77 |

FOREIGN PATENT DOCUMENTS

| | | | |
|---|---|---|---|
| 2545161 | 4/1977 | Fed. Rep. of Germany | 101/416 A |
| 1126079 | 11/1956 | France | 101/416 A |
| 489819 | 8/1938 | United Kingdom | 101/416 A |
| 1182492 | 2/1970 | United Kingdom | 101/416 A |

*Primary Examiner*—William Pieprz

*Attorney, Agent, or Firm*—Steele, Gould & Fried

[57] ABSTRACT

Apparatus for drying printed web material comprises a chamber housing a fan disposed within a casing, the casing having a fan inlet open to the interior of the chamber. An outlet duct is provided for discharging drying flow of air from the fan to outside the chamber. A heater is provided for heating said flow, and means are provided for directing the heated air on to the printed web. A collector hood is provided for collecting the solvent mixture resulting from the web-drying operation. First and second outlet ducts allow outflow of the collected solvent mixture from the collector hood, the first outlet duct being connected to the inlet of the fan by way of the chamber interior. A fresh air inlet duct is also connected to the chamber interior, and separate valves in the form of louvres are provided for controlling flow through the first and second outlet ducts as well as the fresh air inlet duct.

8 Claims, 7 Drawing Figures

DRYING PRINTED WEB MATERIAL

BACKGROUND TO THE INVENTION

This invention relates to drying printed web material. In rotary printing machines, and in particular in rotogravure printing machines, a web is printed at different printing stations in sequence. Invariably, at each printing station, there is a different amount of ink printed onto the web. This may vary from complete coverage of the web to approximately 10% coverage thereof. It is, of course, important that the printing ink is dry before the printed web is allowed to pass from one printing station to the next.

To ensure that adequate drying is achieved, each printing station is provided with web drying apparatus whereby a printed portion of the web is dried before that portion is allowed to pass through to the next printing station.

Ink used in rotary printing machines comprises a mixture of colour pigments and a binder, together with a solvent which acts as a carrier for the ink. The solvent is of a volatile nature and a mixture of evaporated solvent with air presents an explosion hazard if the air/solvent volume ratios (v/v) are in the flammable range of the particular solvent or solvents being employed. Each solvent has its own flammable range. For example, a solvent known as TOLUENE has a range of 1.3% to 7% v/v, being quantified as 1.3% Lower Explosive Limit (L.E.L.) and 7% Upper Explosive Limit (U.E.L.). The U.E.L. does not enter into calculations as a web drying system should be designed on excess air volumes relative to the flammable range.

In the case of printing machines which do not incorporate continuous automatic sensing means for determining the concentration level of solvent vapour/air mixtures, it is a requirement in the United Kingdom by H.M. Factory Inspectorate that the mixture level must not exceed 25% of the L.E.L. of the particular solvent or solvents used. But in printing machine with continuous automatic sensing means, 45% of the L.E.L. is permitted provided that at 50% an audible warning is given automatically and at 55% the printing machine is automatically stopped.

Known apparatus for drying printed web material make use of heated air which is discharged on to the printed portion of web so as to dry it.

The L.E.L. is maintained at a permissible level by collecting the mixture of heating air and solvent vapour resulting from the web-drying operation, (hereafter the solvent mixture).

SUMMARIES OF THE INVENTION

According to the present invention, apparatus for drying printed web material comprises a device for producing pressurized air, said device having a suction side and a discharge side, means for discharging a drying flow of air from the discharge side of said device, means for heating said flow, means for directing the heated air on to the web, collector means for collecting the solvent mixture resulting from the web-drying operation, first and second outlet means for allowing outflow of the collected solvent mixture from said collector means, said first outlet means being connected to the suction side of said device for producing pressurised air, fresh air inlet means connected to the said suction side of said device, and valve means for controlling flow through the first and second outlet means and also the fresh air inlet means.

The settings of the valve means provide for specific requirements.

Preferably the device for producing pressurized air comprises a chamber housing a fan or other suitable air-moving device.

By suitable control of the valve means, the dangerous solvent mixture can be maintained at a permissible level.

The valve means may be automatically and/or manually controlled.

The invention also comprises a combination of said apparatus for drying printed web material and a machine for printing the web.

The invention further comprises web material printed by the combination.

Another aspect of the invention comprises a method of drying web material, substantially as hereinafter described, with reference to the accompanying drawings.

BRIEF DESCRIPTION OF THE DRAWINGS

An embodiment of the invention will now be described, by way of example only, with reference to the accompanying drawings, wherein.

DETAILED DESCRIPTION OF THE PREFERRED EMBODIMENT

Figure 1:
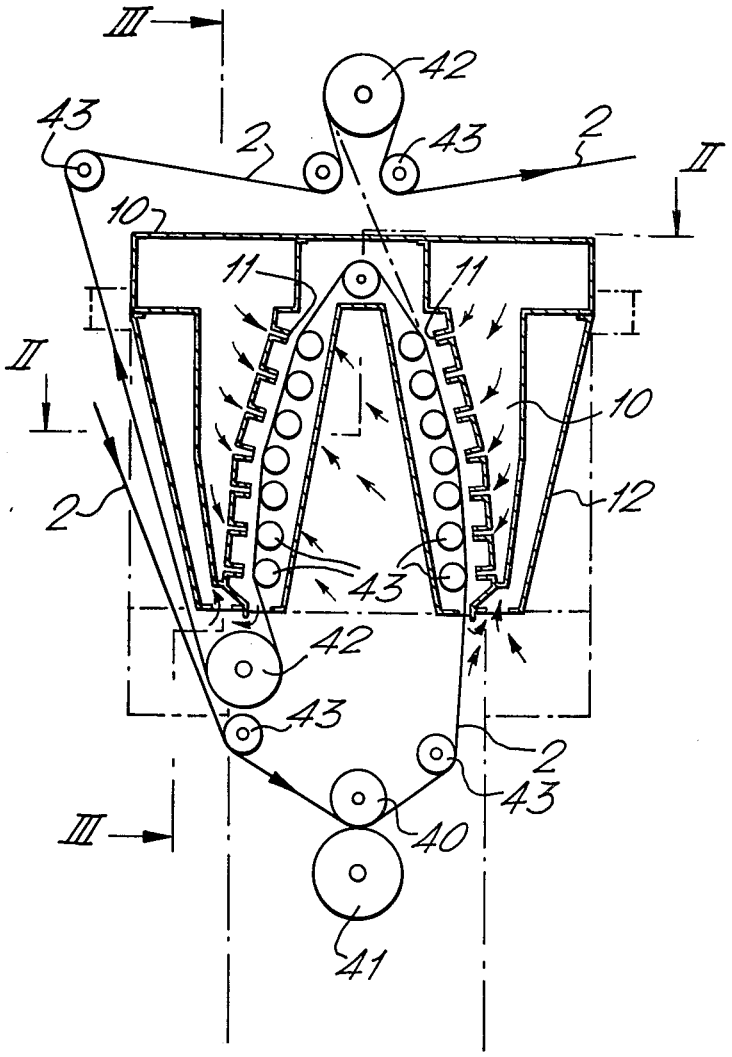
FIG. 1 is a side view, in section, of parts of a rotary printing machine and web-drying apparatus.
Figure 2:
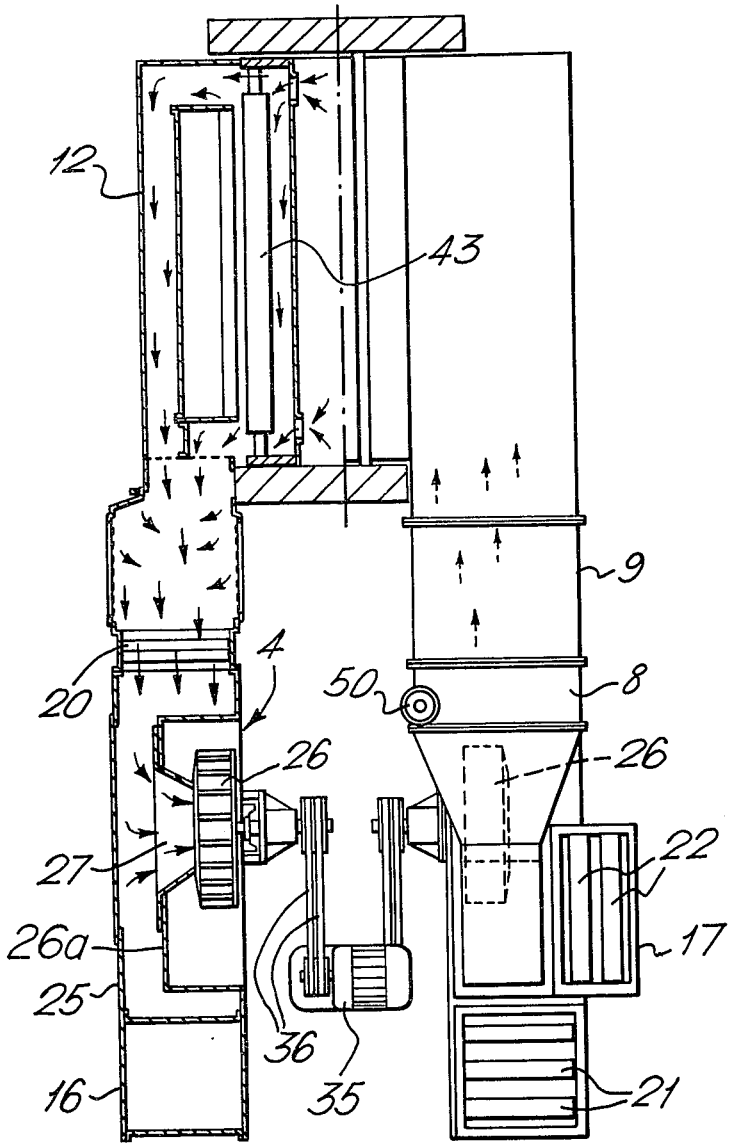
FIGS. 2 and 3 are sectional views, taken on the lines II—II and III—III respectively, of FIG. 1, FIGS. 4, 5 and 6 are perspective views, with parts cut away, of the device for producing pressurised air, and related components, in various modes of operation.
Figure 3:
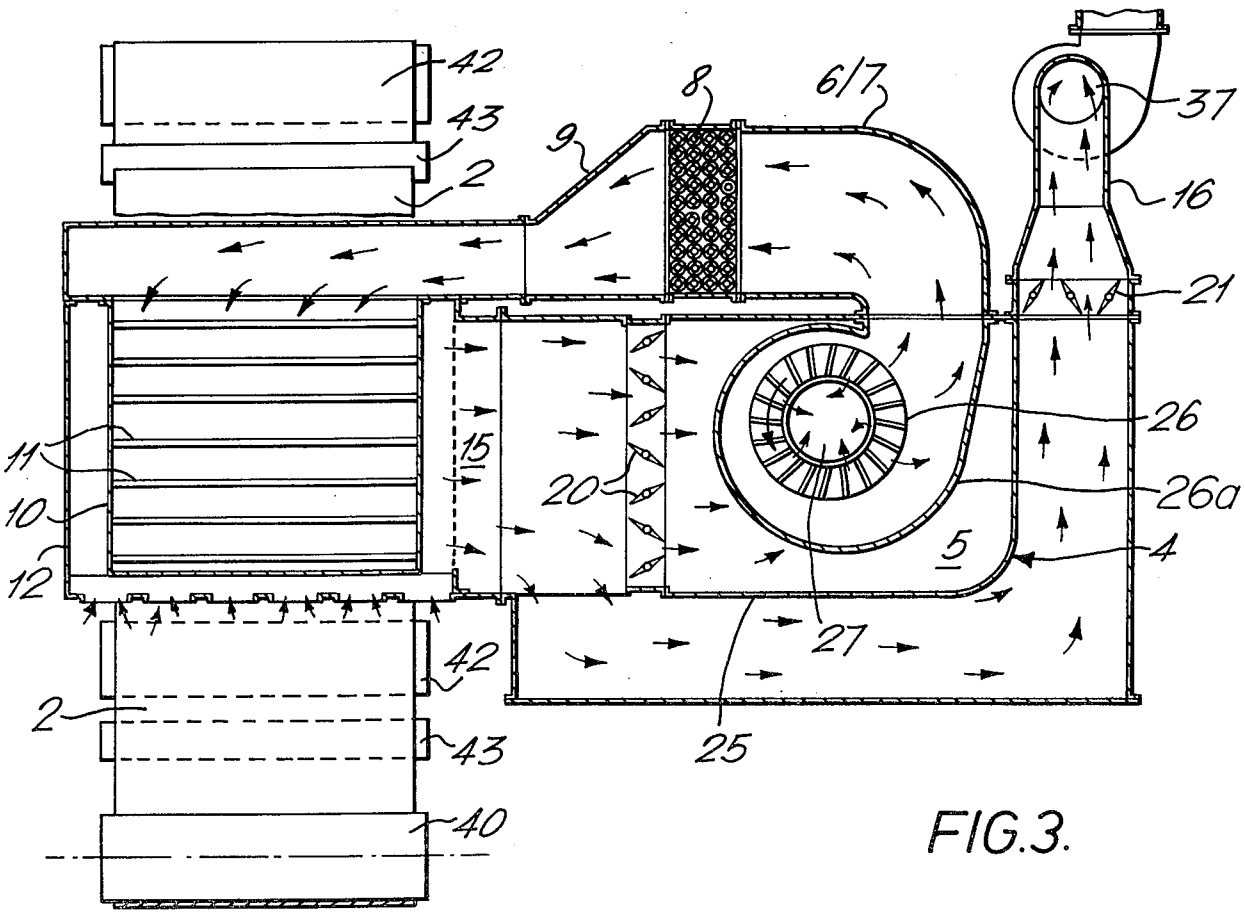
Figure 4:
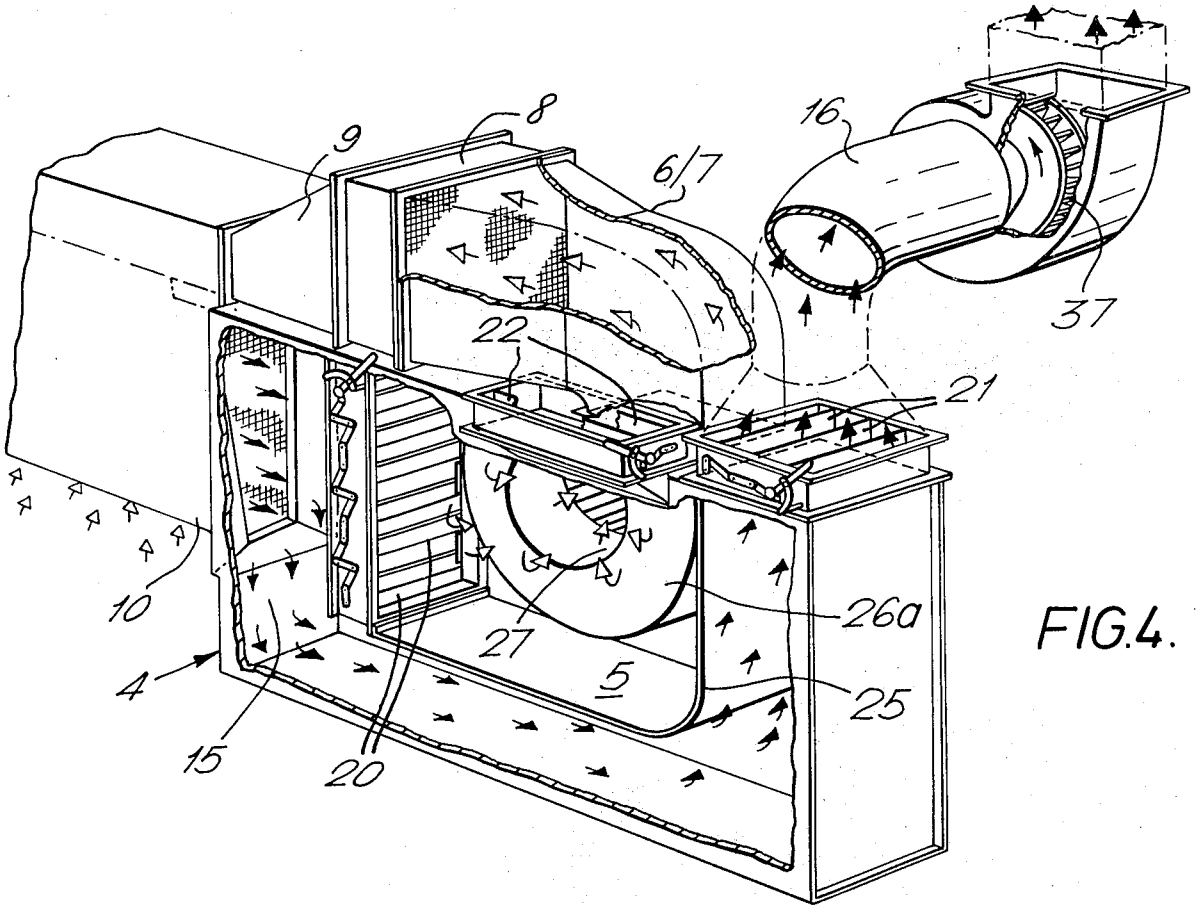

With reference to FIGS. 1, 2, 3, 4 and 7, apparatus 1 for drying web material 2 printed by a rotary printing press 3 comprises a device 4 for producing pressurised air, the device 4 having a suction side 5 and a discharge side 6, means comprising a duct 7 for discharging a web-drying flow of pressurised air from the discharge side 6, a heater 8 for heating the flow, means comprising a duct 9 and plenum chamber 10 with air-outlet nozzles 11, for directing the heated air on to the web 2, and collecting means comprising a hood 12 for collecting the solvent mixture resulting from the web-drying operation as well as fresh air present in the press room and surrounding the press. The apparatus 1 further comprises first and second outlet means in the form of ducts 15 and 16 for allowing outflow of the collected solvent mixture from the hood 12, the first duct 15 being connected to the suction side 5 of the device 4, fresh air inlet means in the form of a duct 17 also connected to the suction side 5, and valve means in the form of flap valves or louvres 20, 21, 22 for controlling flow through the first and second outlet ducts 15, 16 and the fresh air inlet means 17, respectively.

Figure 7:
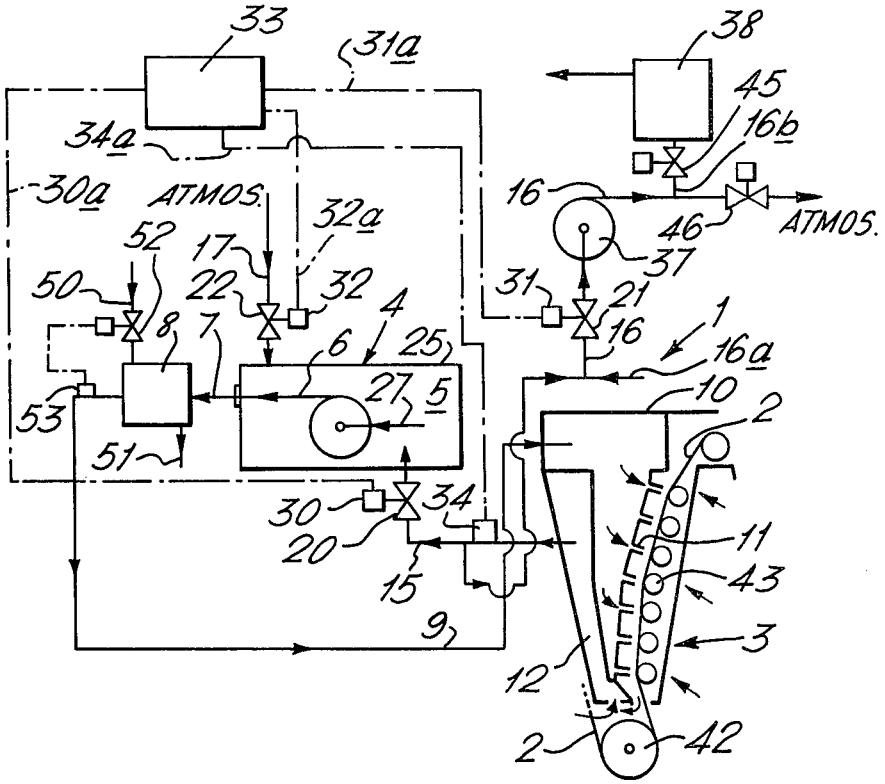
FIG. 7 illustrates, in a diagrammatic manner, the drying apparatus of the invention.

In this example, the printing machine 3 is an electrically-powered rotogravure printing machine, comprising a number of identical or substantially identical printing stations, (one for each colour or colour shade). However, only one station is illustrated in the accompanying drawings. Each printing station has its own drying apparatus 1 which actually makes use of a pair of drying hoods 12 and plenum chambers 10. (See FIG. 1). With reference to FIG. 7, a branch duct **16*a* is provided whereby the non-illustrated chamber/hood assembly (10/12) is connected with duct 16. The hoods 12** pick up some of the ambient air in the vicinity of the hoods at the same time as they collect solvent mixture.

The device 4 comprises a casing or chamber 25 which houses a fan 26 disposed in a casing 26*a*. The inlet 27 of the fan 26 is open to the interior of the chamber 25, which interior serves as the suction side 5 of the device 4. The outlet of the fan 26 comprises the discharge side 6 of the device 4. Discharge side 6, i.e. outlet of fan 26, is integral with duct 7 so as to form, in effect, a single duct (6/7) leading the heater 8.

In the example, heater 8 comprises a nest of tubes through which steam is caused to flow, by way of inlet and outlet ducts 50, 51, and over which the drying flow of air is caused to pass. However, other forms of heater, for example, a gas-flame heater or an electrical heater can be used, if desired. (It will be appreciated that certain precautions will need to be taken if a gas-flame heater is employed. For example, under current U.K. regulations, the heater must be disposed at least 5 meters away from the printing station).

Steam flow through heater 8 is automatically controlled by a motorized valve 52 regulated by a device 53 sensitive to air temperature on the discharge side of the heater. Thus the thermal output of heater 8 can be controlled so as to heat the web-drying flow of air to a substantially constant temperature, and in an automatic manner.

In this example, valves 20, 21, 22 are operable by motors 30, 31, 32 respectively, but can also be operated manually if desired. The motors 30, 31, 32 are connected to a L.E.L.-sensitive control box 33 which makes use of a L.E.L. sensing device 34 disposed between ducts 15 and 16. Motors 30, 31, 32 and sensing device 34 are connected to control box 33 by electrical signal lines 30*a*, 31*a*, 32*a*, 34*a* respectively. The control box 33 is provided with means (not shown) whereby various settings of valves 20, 21, 22 can be obtained. Thus the device 34, being sensitive to changes in the air to solvent ratio of solvent mixture being collected by hoods 12, is operable so as to adjust the valves 20, 21, 22 whereby flow through ducts 15, 16 and 17 is controlled automatically. Control box 33 can also shut down the printing machine 3 if the solvent mixture reaches the maximum permissible level. This can be done by control box 33 terminating the supply of current to the printing machine.

Fan 26 is driven by an electric motor 35 (FIG. 2) via endless belts 36. An exhaust fan 37 disposed in vent duct 16 is driven by similar components (not shown). The fan 37 can discharge to a solvent-recovery plant 38 via a branch duct 16*b*, and/or to atmosphere. Motorized diversion valves 45, 46 are provided for flow diversion purposes, whereby duct 16 can be selectively connected with the recovery plant 38 and/or atmosphere. Fan speeds can be altered by fitting fan belt pulleys of different sizes.

With reference to FIG. 1, each station of the printing machine 3 is provided with an impression cylinder 40, image cylinder 41 and a large number of large and small diameter guide rollers 42, 43.

The web 2 enters the printing station of the machine 3 to enter the nip between impression/image cylinders 40/41 and then passes upwardly over guide rollers 43 adjacent the "right hand" plenum chamber 10 whereby the freshly-applied ink on the web is partially dried by warm air discharged through nozzles 11. The web 2 is then caused to pass over guide rollers 43 adjacent the "left hand" chamber 10 whereby drying is completed.

If the coating weight is low, only the "right hand" plenum chamber 10 needs to be used.

The invention allows three modes of operation, using control box 33 or manual operation, namely:

(a) A "straight through" flow whereby, (see FIG. 4), louvres 20 are closed and louvres 21, 22 are opened. Fresh atmospheric air is then induced into chamber 25 via duct 17, and by fan 26, is heated by heater 8, and discharged on to the web 2. Solvent mixture (which includes ambient air), is drawn into hood 12 by fan 37 to be discharged to atmosphere and/or the solvent-recovery plant 38.

Figure 5:
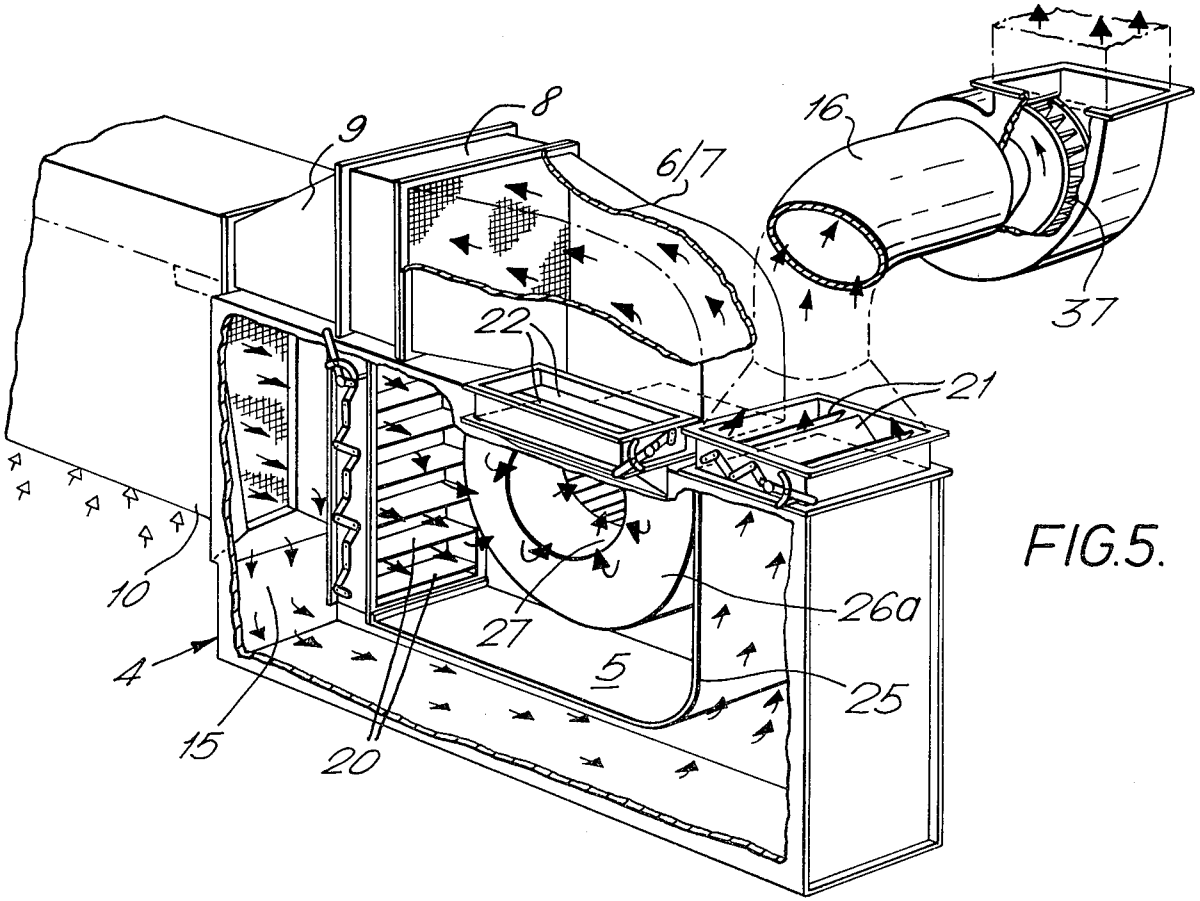

(b) A "recirculation" flow, (see FIG. 5), wherein louvres 22 are closed, louvres 20 opened fully and louvres 21 closed partially by a predetermined amount. Solvent mixture drawn into hood 12 by fans 26 and 37 passes to chamber 25 for re-use. The remainder is discharged to atmosphere and/or recovery plant 38.

Figure 6:
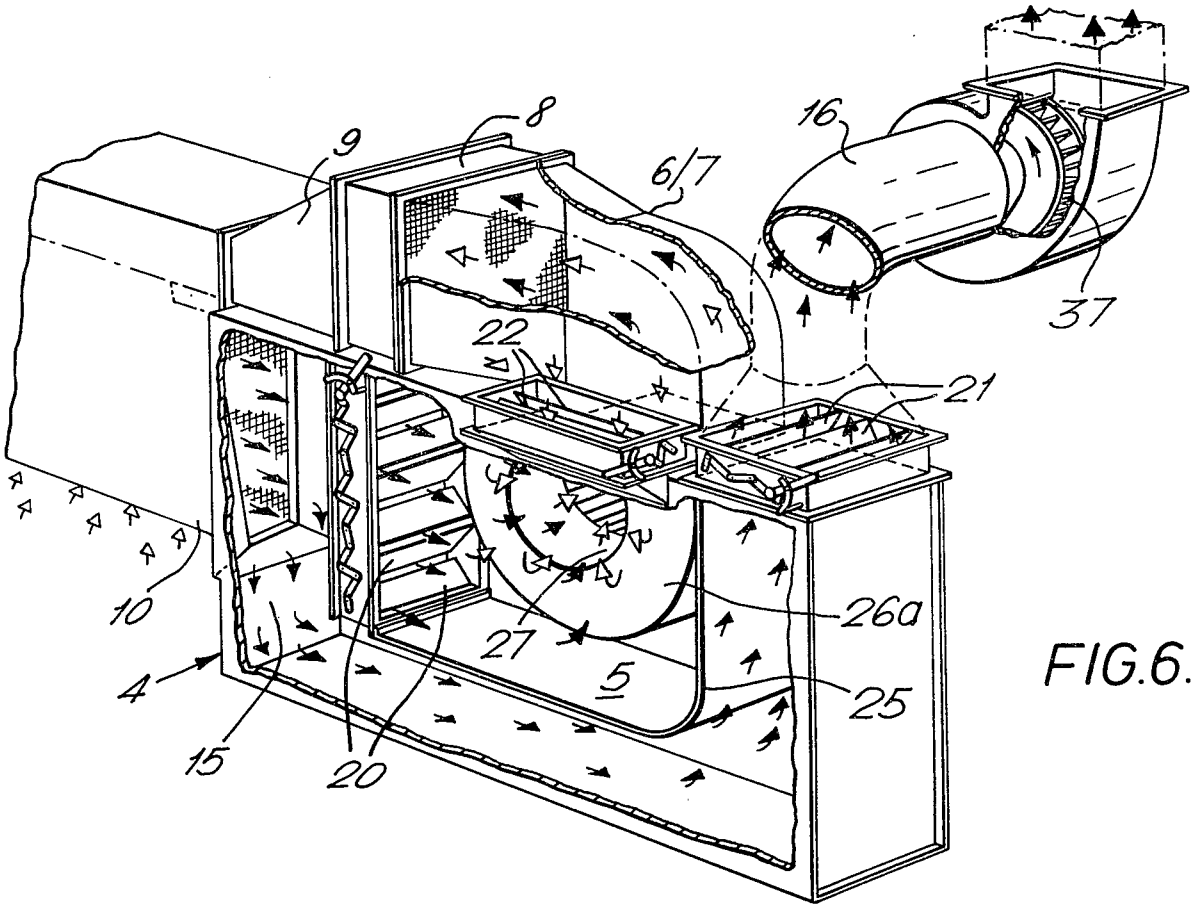

(c) A drying flow between (a) and (b) wherein (see FIG. 6), louvres 20, 21, 22 are all partially closed. (To varying amounts if desirable and/or necessary). This allows fresh atmospheric air to be drawn into chamber 25, some of the solvent mixture to be recirculated and the remainder thereof to be discharged to atmosphere and/or plant 38.

The invention provides the following advantages:

(1) Efficient and economical use of air-heating energy. For example, when mode (b) or (c) is employed, the smaller volume of fresh atmospheric air induced into the system demands less output from heater 8, thus saving fuel costs.

(2) Employment of "straight-through" or "recirculation" modes, i.e. modes (a) or (b), or alternatively, mode (c) which is between mode (a) and (b).

(3) No restriction on web printing speeds, as experienced with recirculatory air dried systems.

(4) Infinite variation of recirculatory solvent mixture levels relative to exhaustion solvent mixture levels.

(5) Various forms of air heating arrangements can be employed without substantial design changes. (Excepting, perhaps, with regard to choice of air heater).

(6) Maintainance of maximum allowable L.E.L. levels. (Except when low ink weights are applied).

Printing machine operators will be aware of the maximum ink coating weights employable at various web printing speeds. Control box 33, (if used), dictates the drying mode required, and this effects maximum economy.

I claim:

1. Apparatus for drying printed web material, comprising:

a chamber, housing a fan disposed within a casing, said casing having a fan inlet in open communication with the interior of said chamber;

duct means for discharging a drying flow of air from said fan to outside said chamber;

means disposed outside said chamber for heating said flow;

means disposed outside said chamber for directing the heated air onto the printed web;

collector means for collecting the solvent mixture resulting from the web-drying operation;

first and second outlet means for allowing outflow of the collected solvent mixture from said collector means, said first outlet means being connected to the interior of said chamber;

fresh air inlet means also connected to the chamber interior; and, valve means for independently controlling flow through the first outlet means, the second outlet means and the fresh air inlet means whereby the solvent mixture can be both recirculated and exhausted, without opening the fresh air inlet means.

2. Apparatus as claimed in claim 1, provided with an atmospheric outlet means and solvent recovery means and means for selectively connecting the second outlet means with one or either of the atmospheric outlet means and the solvent recovery means.

3. Apparatus as claimed in claim 1, wherein the valve means comprise louvres.

4. Apparatus as claimed in claim 1, provided with means sensitive to the temperature of the drying flow of air and operable so as to control the thermal output of the means for heating said flow.

5. Apparatus as claimed in claim 1, provided with control means sensitive to changes in the air to solvent ratio of the solvent mixture and operable so as to adjust the valve means for controlling flow through the first and second outlet means and also the fresh air inlet means.

6. The combination of apparatus as claimed in claim 1, and a machine for printing the web.

7. The combination of claim 6, further comprising control means sensitive to changes in a ratio of the air and solvent in the solvent mixture and operable so as to adjust the valve means for controlling flow through the first and second outlet means and the fresh air inlet means, and operable to shut down said machine.

8. The combination of claim 6, wherein said machine comprises a rotogravure printing machine.

* * * * *